US006092289A

United States Patent [19]

Schad

[11] Patent Number: 6,092,289

[45] Date of Patent: Jul. 25, 2000

[54] COLLAPSIBLE CIGAR CORER

[75] Inventor: Clemens T. Schad, Aesch, Switzerland

[73] Assignee: Davidoff & Cie SA, Geneve, Switzerland

[21] Appl. No.: 09/129,210

[22] Filed: Jul. 30, 1998

[51] Int. Cl.[7] ..... A24F 13/26; B26B 13/22

[52] U.S. Cl. ..... 30/112; 30/109; 30/124; 7/118; 7/158

[58] Field of Search ..... 30/109, 111, 113.1, 30/113.3, 124, 123, 136, 143; 7/158, 118; 131/253, 255

[56] References Cited

U.S. PATENT DOCUMENTS

| | | | |
|---|---|---|---|
| D. 50,095 | 12/1916 | Firbas . | |
| D. 57,636 | 4/1921 | Gits . | |
| D. 175,663 | 9/1955 | Anselmi . | |
| 202,559 | 4/1878 | Lipman . | |
| D. 223,133 | 3/1972 | Olt . | |
| D. 270,953 | 10/1983 | Langtry . | |
| 292,473 | 1/1884 | Dietrich et al. . | |
| 297,959 | 4/1884 | Ungerer . | |
| 344,370 | 6/1886 | Greth . | |
| 376,511 | 1/1888 | Carter . | |
| 464,405 | 12/1891 | Widmann . | |
| 630,119 | 8/1899 | Schott . | |
| 864,703 | 8/1907 | Sibley . | |
| 899,407 | 9/1908 | Kampfe . | |
| 899,408 | 9/1908 | Kampfe . | |
| 1,043,338 | 11/1912 | Meyerson . | |
| 1,058,049 | 4/1913 | Greenhut . | |
| 1,094,338 | 4/1914 | Leisegang | 30/109 |
| 1,109,073 | 9/1914 | Labreche . | |
| 1,454,994 | 5/1923 | De Matteo . | |
| 2,188,362 | 1/1940 | Krilow | 30/113.3 |
| 3,913,566 | 10/1975 | Lacey | 30/113.1 |
| 5,694,691 | 12/1997 | Chen . | |

FOREIGN PATENT DOCUMENTS

| | | |
|---|---|---|
| 606 510 | 3/1926 | France . |
| 1 250 859 | 3/1961 | France . |
| 14 750 | 1/1881 | Germany . |
| 296 22 111 U | 3/1997 | Germany . |
| 040 136 | 5/1997 | Switzerland . |
| 206 688 | 11/1923 | United Kingdom . |

*Primary Examiner*—Hwei-Slu Payer
*Attorney, Agent, or Firm*—Darby & Darby

[57] ABSTRACT

A collapsible cigar corer tool assembly is disclosed having a body and a collapsible cigar corer including at least one cutting aperture with a fixed, circumferential, cutting blade. The cap of a cigar is prepared for coring an opening by urging the cap against the cutting blade and by rotating the cigar relative to the aperture. The cigar corer is mounted on the tool assembly such that it pivots between two positions, a first closed position in which the cutting aperture is housed within the body, and a second open position in which the cutting aperture is in an operative position outside the body.

10 Claims, 3 Drawing Sheets

COLLAPSIBLE CIGAR CORER

BACKGROUND OF THE INVENTION

1. Field of the Invention

The present invention relates to a cigar corer for preparing a cigar for an easy draw by the smoker. More specifically, the invention relates to a collapsible cigar corer which may be folded into a pocket knife like a blade.

2. Description of the Related Art

Cigar cutters and corers come in many unusual shapes and forms. Over the time, they became an elusive collectible item. However, cigar cutters and corers are not just smoking memorabilia, they also fulfill an important task for the expectant smoker. Cigars, as is commonly known, have a closed cap. The cap is the area were the outer wrapper leaf of the cigar is fastened down. The cap prevents the cigar from unraveling. However, before the cigar can be smoked, the cap has to be cut, clipped, plugged, pierced or punctured to provide the smoker with the desired draw. The size of the opening in the cap is somewhat subject to personal taste, but also depends on the size of the cigar or the amount of desired draw. The opening should provide a comfortable draw without tearing of the wrapper. Thus, it is preferable to have a choice of cutting or piercing devices available for different sizes or types of cigars.

One known cigar cutter, commonly referred to as a "guillotine" type cigar cutter, includes an aperture for inserting a cigar tip to be cut, and a pivotable or slidable blade for cutting a portion of the cigar cap at or adjacent to the aperture. Such devices are embodied in various shapes and forms, and may be incorporated in an assembly including additional tools, such as a collapsible pocket knife assembly. For example, U.S. Pat. No. 899,408 discloses a pocket-knife assembly including a collapsible knife and various other collapsible tools. An aperture on the body of the pocket-knife assembly is used for inserting a cigar cap. To cut the cigar cap, the collapsible knife is pivoted adjacent the aperture.

Another type of cigar cutter known in the art consists of an aperture and a fixed blade along the circumference of the aperture. The aperture and circumferential blade are shaped and configured to cut a cigar cap by inserting the cigar cap into the aperture, urging the cigar against the aperture, and rotating the cigar relative to the aperture, whereby the circumferential blade produces a cut which separates a predetermined portion of the cigar cap. The size of the portion of the cigar cap being separated depends on the diameter of the cigar and, therefore, the aperture diameter is adapted to accommodate only a limited range of cigar cap thicknesses. Thus, in practice, different aperture sizes are used for cutting different cigar types.

Other devices that provide an opening in the cap of a cigar provide for an opening by coring into the cigar cap. These devices generally include a cylindrical corer that is retractable into a larger cylindrical device which than can be, for example, attached to a key chain and thus, is always easily available to the cigar smoker. However, certain smokers prefer not to carry either an individual cylindrical corer around, nor do they choose to carry a corer on a key chain in their pockets.

SUMMARY OF THE INVENTION

It is an object of the present invention to provide a collapsible tool assembly including a collapsible cigar corer having a circumferential cutting aperture included in the collapsible cigar corer.

A collapsible tool assembly in accordance with the present invention includes a body and a collapsible cigar corer having at least one coring aperture adapted for coring into a cigar cap within a predetermined thickness range.

In an embodiment of the present invention, the coring aperture has a predetermined diameter, corresponding to the predetermined thickness range, and includes a fixed, circumferential, cutting blade adapted for coring a portion of the cap of a cigar when the cigar is urged against the aperture and rotated relative thereto.

In another embodiment of the present invention, the collapsible cigar corer is pivotable from a first, closed, position in which at least one coring aperture is housed within the body of the collapsible tool assembly, to a second, open, position in which the coring aperture is in an operative position outside the body of the collapsible tool assembly.

In another embodiment of the present invention, the collapsible tool assembly includes a tool in addition to the collapsible cigar corer, for example, a collapsible knife as is known in the art.

In another embodiment of the present invention, the collapsible cigar corer has a plurality of coring apertures, each aperture having a different diameter, whereby different sized draw openings may be cut into the cap by the different apertures. In one embodiment of the present invention, the collapsible cigar corer has three coring apertures, each aperture having a different diameter, whereby three draw openings are provided.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The present invention will be better understood from the following detailed description of a preferred embodiment of the invention taken in conjunction with the following drawings in which:

FIG. 5 is a schematic, rear view, illustration of the collapsible tool assembly of FIG. 1*a.

DETAILED DESCRIPTION OF THE PRESENTLY PREFERRED EMBODIMENTS

Figure 1A:
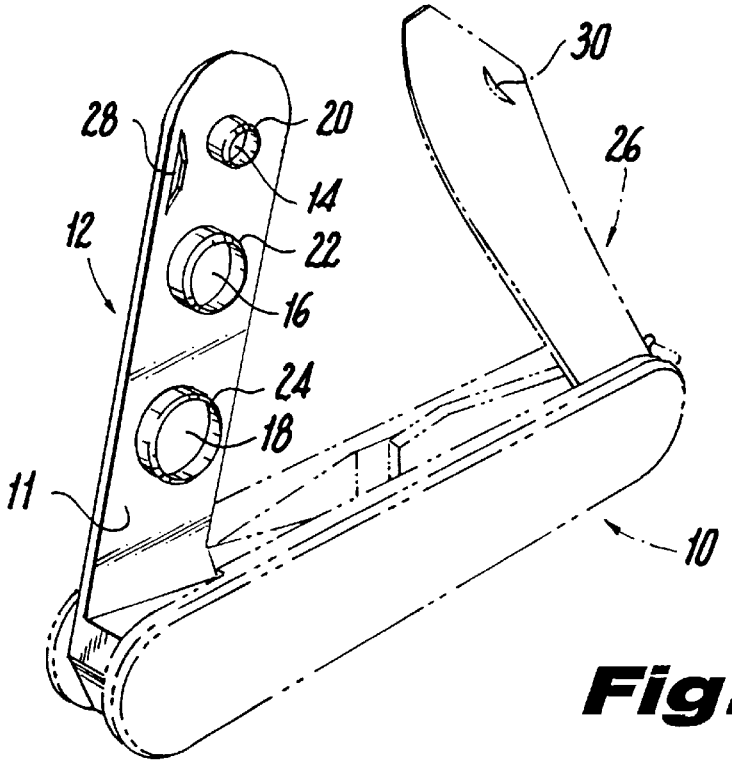
FIGS. 1*a* and 1*b* are schematic, right-rear perspective views, illustrations of a collapsible tool assembly including a cigar corer.

Reference is made to FIGS. 1–6 which schematically illustrate a collapsible tool assembly in accordance with an embodiment of the present invention. The collapsible tool assembly includes a body 10 and a collapsible cigar corer 12 having a right surface 11 and a left surface 13. Collapsible cigar corer 12 blade includes at least a first coring aperture 14, a second coring aperture 16 and a third coring aperture 18, each having a different diameter. The diameters of apertures 14, 16 and 18 are preferably adapted to accommodate different cigar cap thickness ranges as are known in the art or to provide three differently sized openings into a cigar to facilitate different draws.

It should be appreciated that the three-aperture embodiment of collapsible corer 12, as described herein, is merely an example. In other embodiments of the present invention, collapsible cigar corer 12 may include only one, as shown in FIG. 1*b* or two cutting apertures, or more than three apertures, depending on specific design requirements .

Apertures 14, 16 and 18 include circumferential cutting blades, 20, 22 and 24, respectively, which preferably protrude from right surface 11 of cigar cutter 12. Each of circumferential cutting blades, 20, 22 and 24 is shaped to produce a circumferential cut of a predetermined diameter in a cigar cap (within the respective thickness range) when such cigar cap is urged against the cutting blade and rotated relative to cigar cutter 12. It has been found that the coring is accomplished in a preferred way when if the circumferential cutting blade is designed such that the blade comprises an outwardly chamfered or tapered edge 36,38 and 40 viewed axially. This design also allows to withdraw the plug which is cored out from the cigar to be more easily removed from the cigar or the corer.

In accordance with the present invention, collapsible cigar corer 12 is pivotable from a first, closed, position (not show in the drawings), in which apertures 14, 16 and 18 are housed within body 10, to an open position (as shown in the drawings), in which apertures 14, 16, and 18 are positioned outside body 10 and are ready for coring a cigar caps. It should be appreciated that in the closed position of collapsible cigar cutter 12, apertures 14, 16 and 18, and their respective blades, 20, 22 and 24, are protected by body 10 from contact with potentially damaging objects outside body 10. Further, in the closed position of cigar cutter 12, the users of the collapsible tool assembly are protected from blades 20, 22 and 24, which may be very sharp.

Figure 1B:
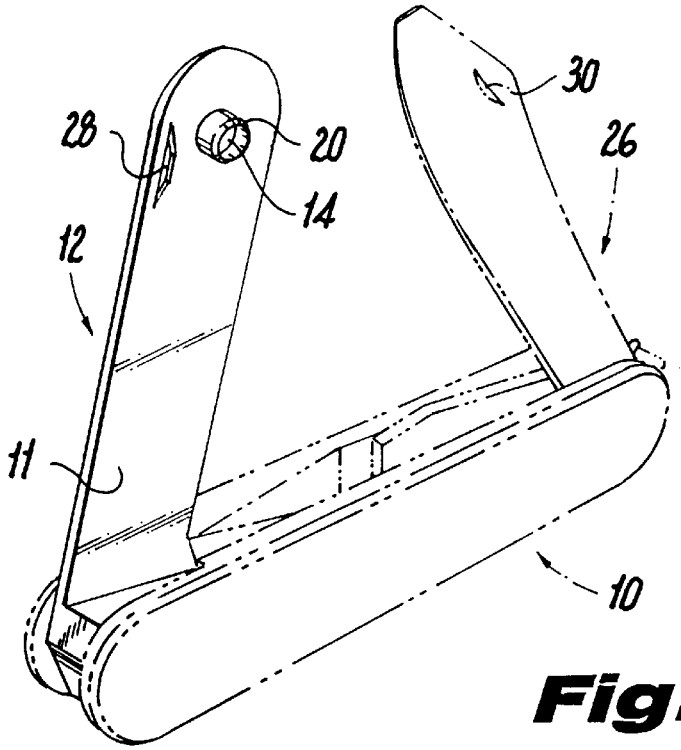
Figure 4:
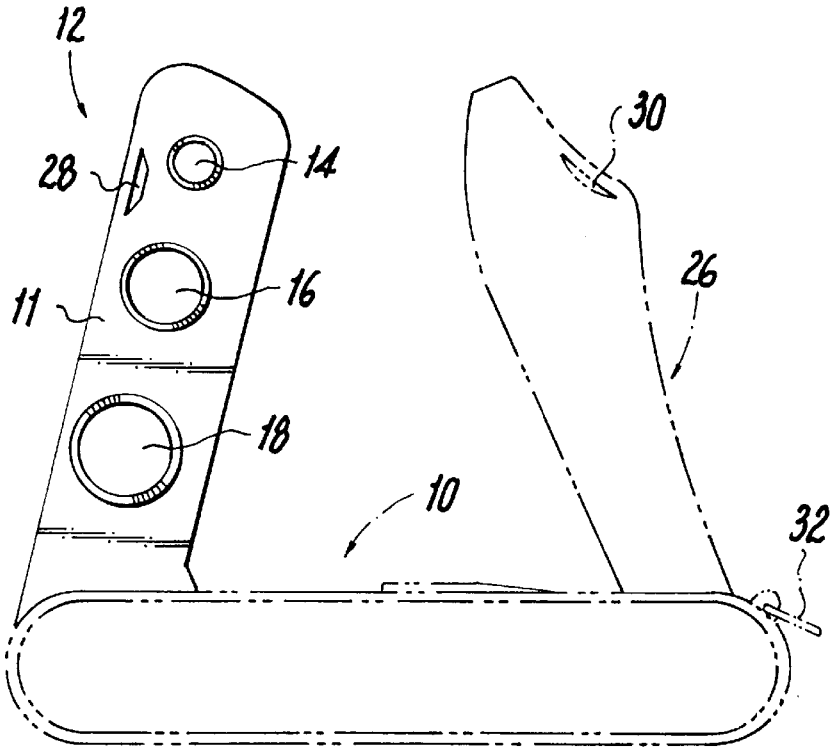
FIG. 4 is a schematic, right side view, illustration of the collapsible tool assembly of FIG. 1*a;*
Figure 5:
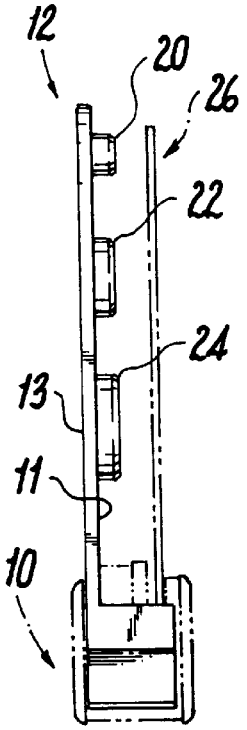
Figure 6:
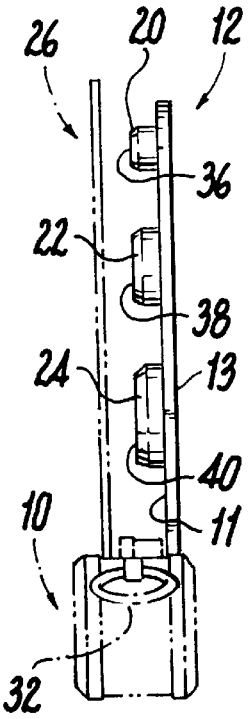
* and FIG. 6 is a schematic, front view, illustration of the collapsible tool assembly of FIG. 1*a.*

As shown in FIGS. 1*a* and 4, surface 11 of collapsible cigar corer 12 preferably includes an indentation 28 which enables a user to grasp cigar corer 12, e.g., with a fingernail, and to pivot the cigar corer outwardly to its open, operative, position. To pivot collapsible cigar corer 12 back to the closed position, the user simply applies inward pressure to the outside edge of the cigar corer. Such outward and inward pivoting of collapsible tools is well known in the art.

In an embodiment of the present invention, the collapsible tool assembly includes at least one additional tool. For example, as shown in FIGS. 1*a*–6, the collapsible tool assembly may include a collapsible knife 26, as is known in the art. Knife 26 preferably includes an indentation 30 (FIGS. 1*a* and 4), similar to indentation 28, for grasping knife 26 when the knife is being pivoted to the open position shown in the drawings. To pivot knife 26 back to its closed position (not shown in the drawings) within body 10, the user simply applies inward pressure to the outside edge of knife 26, as known in the art. It should be appreciated that the collapsible tool assembly of the present invention may include any number of additional, collapsible or non-collapsible, tools as are know in the art.

Figure 2:
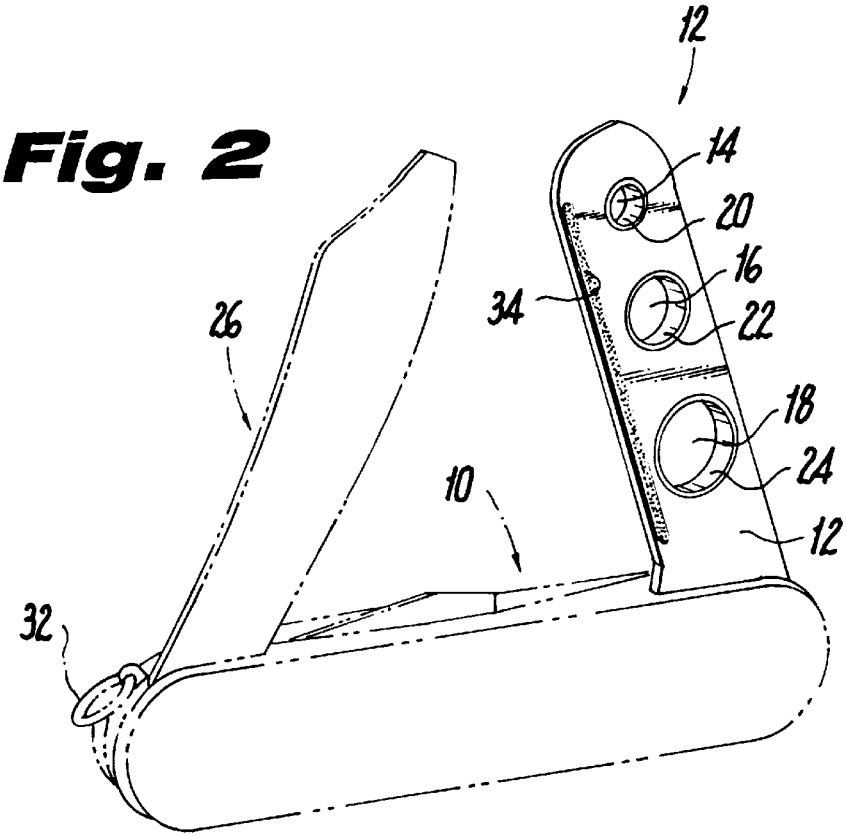
FIG. 2 is a schematic, left-front perspective view, illustration of the collapsible tool assembly of FIG. 1*a;*
Figure 3:
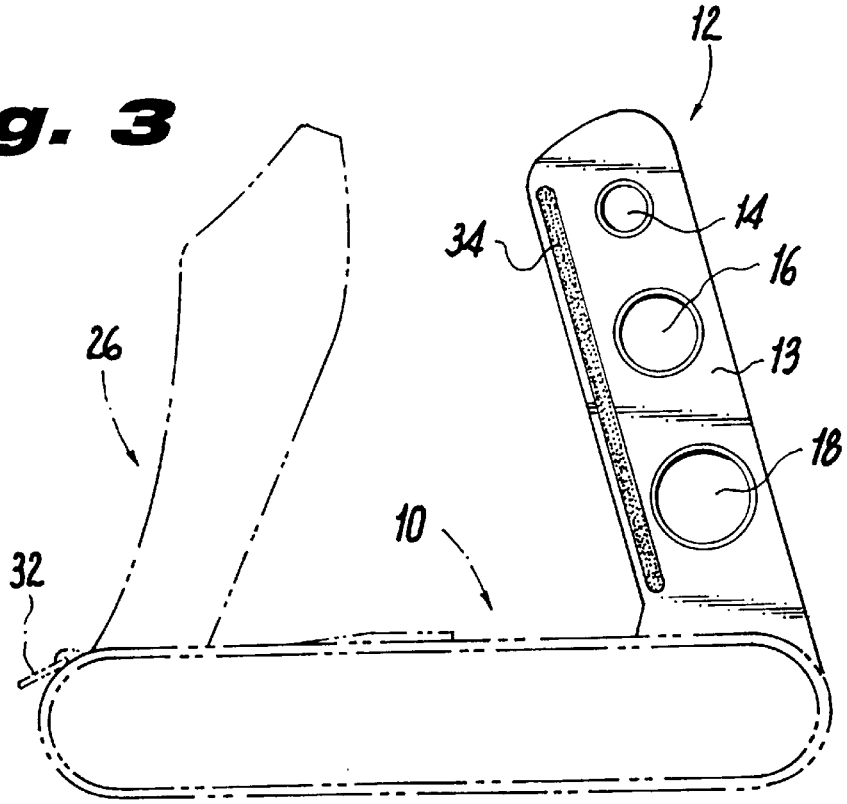
FIG. 3 is a schematic, left side view, illustration of the collapsible tool assembly of FIG. 1*a;*

In an embodiment of the present invention, collapsible cigar corer 12 may further be utilized for purposes other than cutting cigar caps. For example, as shown in FIGS. 2 and 3, left surface 13 of collapsible cigar corer 12 may include a rough region 34, e.g., a diamond-dust coated region. Region 34 may be used as a file, for example, a finger-nail polishing file, as is known in the art.

In an embodiment of the present invention, the collapsible tool assembly includes a ring 32 which may be used for connecting the collapsible tool assembly to a given object, for example, to a key chain, as is known in the art.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A collapsible tool assembly, comprising:

a body; and a collapsible cigar corer including at least one coring aperture having a fixed, circumferential coring blade, said collapsible cigar corer including a substantially flat surface from which said fixed, circumferential coring blade protrudes.

2. A collapsible tool assembly according to claim 1, wherein the coring blade is adapted to core a portion of the cap of a cigar when said cap is urged against the aperture and rotated relative to the aperture.

3. A collapsible tool assembly according to claim 2, wherein the collapsible cigar corer is pivotable from a first, closed, position in which the at least one coring aperture is housed within said body, to a second, open, position in which the at least one coring aperture is in an operative position outside said body.

4. A collapsible tool assembly according to claim 3, wherein said collapsible cigar corer includes means for grasping the collapsible cigar corer to manually pivot the collapsible cigar corer from said first position to said second position.

5. A collapsible tool assembly according to claim 1, further comprising at least one tool in addition to the collapsible cigar corer.

6. A collapsible tool assembly according to claim 5, wherein said at least one additional tool comprises a collapsible knife.

7. A collapsible tool assembly according to claim 1, wherein the collapsible cigar corer includes a plurality of cutting apertures, each of said apertures having a different diameter.

8. A collapsible tool assembly according to claim 7, wherein the collapsible cigar corer has three cutting apertures having three, respective, different, diameters.

9. A collapsible tool assembly according to claim 1, wherein a surface of the collapsible cigar corer includes a rough region adapted to be used as a file.

10. A collapsible tool assembly according to claim 1, wherein said fixed, circumferential coring blade includes an outwardly tapered edge.

* * * * *